US009587364B2

(12) United States Patent
Ayers et al.

(10) Patent No.: US 9,587,364 B2
(45) Date of Patent: Mar. 7, 2017

(54) SYNTHETIC GROUND COVER SYSTEM WITH IMPERMEABLE BACKING AND BINDING INFILL FOR EROSION CONTROL

(71) Applicant: Watershed Geosynthetics, LLC, Alpharetta, GA (US)

(72) Inventors: Michael Ayers, Alpharetta, GA (US); Jose Urrutia, Suwanee, GA (US)

(73) Assignee: Watershed Geosynthetics LLC, Alpharetta, GA (US)

( * ) Notice: Subject to any disclaimer, the term of this patent is extended or adjusted under 35 U.S.C. 154(b) by 0 days.

(21) Appl. No.: 14/186,413

(22) Filed: Feb. 21, 2014

(65) Prior Publication Data

US 2014/0170339 A1 Jun. 19, 2014

Related U.S. Application Data

(63) Continuation-in-part of application No. 13/417,275, filed on Mar. 11, 2012.

(60) Provisional application No. 61/451,839, filed on Mar. 11, 2011.

(51) Int. Cl.
*E02D 17/20* (2006.01)

(52) U.S. Cl.
CPC ..... *E02D 17/202* (2013.01); *E02D 17/20* (2013.01)

(58) Field of Classification Search
CPC ..... E02D 17/202; E02D 17/20; B09B 1/004; E01C 13/08; Y10T 156/10; Y10T 156/1082
See application file for complete search history.

(56) References Cited

U.S. PATENT DOCUMENTS

| | | | | |
|---|---|---|---|---|
| 4,044,179 | A * | 8/1977 | Haas, Jr. | E01C 13/08 428/17 |
| 4,444,815 | A * | 4/1984 | Friedrich | E01C 13/08 428/17 |
| 6,946,181 | B2 * | 9/2005 | Prevost | 428/87 |
| 2003/0039773 | A1 * | 2/2003 | Paschal et al. | 428/17 |
| 2003/0215287 | A1 * | 11/2003 | Prevost | B64F 1/36 404/71 |
| 2005/0238433 | A1 * | 10/2005 | Daluise | 405/46 |
| 2010/0055461 | A1 * | 3/2010 | Daluise | E01C 13/08 428/403 |

FOREIGN PATENT DOCUMENTS

CA 2218314 * 7/2002

* cited by examiner

*Primary Examiner* — Benjamin Fiorello
*Assistant Examiner* — Carib Oquendo
(74) *Attorney, Agent, or Firm* — Baker, Donelson, Bearman, Caldwell & Berkowitz, PC

(57) ABSTRACT

A synthetic ground cover system for erosion control to be placed atop the ground, including a synthetic grass which comprises a composite of one or more geotextiles tufted with synthetic yarns and an impermeable backing/layer. The synthetic ground cover also includes a sand/soil infill ballast applied to the synthetic grass and a binding agent applied to the sand/soil infill to stabilize the sand/soil infill against high velocity water shear forces.

24 Claims, 7 Drawing Sheets

SYNTHETIC GROUND COVER SYSTEM WITH IMPERMEABLE BACKING AND BINDING INFILL FOR EROSION CONTROL

CROSS-REFERENCE TO RELATED APPLICATION

This application is a continuation-in-part of U.S. Non-Provisional patent application Ser. No. 13/417,275, filed Mar. 11, 2012, now pending, which in turn claims the benefit of U.S. Provisional Patent Application 61/451,839 filed Mar. 11, 2011. The benefits, status and priority are claimed as a continuation-in-part application. The patent applications identified above are incorporated herein by reference in their entireties to provide continuity of disclosure and for all purposes.

BACKGROUND

The prior art discloses systems for erosion protection that typically take the form of a combination of synthetic mat and natural grass. Additionally, the prior art generally requires multiple anchors to resist wind uplift and erosion forces on the synthetic mat. Thus, the industry continues to search for improved erosion protection systems which are effective, economical and meet the various local, state and federal environmental laws, rules and guidelines for these systems.

Artificial grass has been extensively used in sport arenas (playing fields) as well as along airport runways and in general landscaping. A primary consideration of artificial turf playing fields is the ability of the field to drain. Examples of prior art in synthetic grass drainage are U.S. Pat. Nos. 5,876,745; 6,858,272; 6,877,932 and 6,946,181. However, these artificial grasses are generally only suitable for field playing surfaces where the ground is substantially flat and the concern is only with the ability to improve field playing conditions.

The drainage use in the prior art of artificial turf deals principally with slow infiltration of flat surfaces to avoid inundation of the field, and such drainage use generally cannot handle the very large and rapid run-off that would occur on very large and steep sideslopes of natural or man-made ground topography, such as landfills, stockpiles, berms, embankments, levees, drainage channels, mine tailing piles, etc.

SUMMARY OF THE INVENTION

Briefly described, the present invention provides a new and useful system for covering various types of sloping ground where water and wind erosion protection are needed. More particularly, in a first example form the invention comprises a synthetic ground cover system for erosion control to be placed atop substantially non-level, sloping ground, including a synthetic grass which comprises a composite of an impermeable backing and synthetic grass blade-like elements secured thereto and extending therefrom. An infill ballast is applied to the synthetic grass atop the backing and a binding agent is applied to the infill ballast to protect the infill ballast against high velocity water shear forces. With this construction, the synthetic ground cover system can remain in place atop substantially non-level, sloping ground despite shear forces from gravity, wind, and water flow.

Preferably, the impermeable backing comprises a geotextile. Optionally, the impermeable backing comprises a permeable geotextile and an impermeable polymer applied to the permeable geotextile to make the backing impermeable. Optionally, the impermeable polymer comprises Polyethylene, Polypropylene, Polyurethane, Ethylene Propylene Diene Terpolymer (EPDM) or Polyvinyl Chloride (PVC).

In one optional form, the impermeable polymer is laminated, glued, sprayed, or coated on the permeable geotextile.

Preferably, the impermeable polymer is non-flat for gripping the non-level, sloping ground.

Optionally, the binding agent in the synthetic ground cover system for erosion control is cement, grout, lime or the like. Optionally, the binding agent can comprise a polymer.

Preferably, the binding agent applied to the infill results in a bound infill having a depth of between about ½ inch and about 2 inches. Also, preferably the infill is applied to the synthetic grass in a dry condition and then is wetted later to be cured into a bound infill. Preferably, the infill comprises a sand or granular material and the binding agent comprises cement. Preferably, the sand-to-cement ratio is between about 1:1 and 3:1 by weight.

Optionally, the synthetic ground cover also includes at least one filter fabric to be placed on or in the ground and an open grid mesh positioned between the synthetic grass and the filter fabric. Preferably, the at least one filter fabric comprises non-woven synthetic fabric. Also preferably, the open grid mesh comprises a synthetic drainage system. Optionally, the synthetic ground cover can include at least one low permeability barrier geomembrane to be placed adjacent the ground.

Optionally, the synthetic grass has a density of between about 20 ounces per square yard and 120 ounces per square yard. Preferably, the synthetic grass has fibers with an average length of between about 0.5 and 4 inches that act as reinforcement for the sand/soil infill. Optionally, the the synthetic grass has fibers with an average length of between about 1.5 and 3 inches.

Preferably, the filter fabric is positioned to be in direct contact with the ground surface and comprises woven synthetic fabric. Alternatively, the synthetic fabric can be a non-woven material.

In another example form, the invention comprises a method of covering ground for erosion control. The method includes the steps of: (a) placing a synthetic grass atop the ground, the synthetic grass having a backing and synthetic grass blades extending therefrom; (b) applying a dry infill ballast to the synthetic grass; and (c) applying a wetting agent to the dry infill to cure the dry infill into a bound infill to stabilize the infill against high velocity water shear forces.

Optionally, the dry infill ballast includes cement and the wetting agent comprises water.

In another example form, the invention comprises a method of covering ground for erosion control. The method includes the steps of: (a) placing a synthetic grass atop the ground, the synthetic grass having a backing and synthetic grass blades extending therefrom; (b) applying a dry infill ballast to the synthetic grass; and (c) applying a wet binding agent to the dry infill to bond the dry infill into a bound infill to stabilize the sand/soil infill against high velocity water shear forces.

Optionally, the dry infill ballast includes granular material and the binding agent comprises a polymer. In another form, the binding agent comprises a cementitious slurry. Optionally, the dry infill ballast can include sand and/or gravel.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

BRIEF DESCRIPTION OF THE DRAWING FIGURES

DETAILED DESCRIPTION

The present invention provides an erosion protection layer for use in embankments, ditches, levees, water channels, downchutes, landfills and other steep topographic ground conditions that are exposed to shear forces of water and winds.

In one example form of the present invention, a synthetic grass is used in combination with a bound/stabilized infill ballast to provide a new and useful ground cover system, while also providing a beneficial erosion protection system that does not require maintenance. This combination (sometimes referred to as a composite material) can be used for covering slopes and lining drainage ditches, swales, and downchutes. With the cover system of this invention, owners and operators can realize significant cost savings by constructing a cover system with synthetic grass that does not require the vegetative support and does not require a topsoil layer typical of the known prior art final cover systems.

More particularly, in a first example form the invention comprises a synthetic ground cover system for erosion control to be placed atop the ground, including a synthetic grass which comprises a composite of one or more geotextiles tufted with synthetic yarns. The synthetic ground cover also includes a stabilized/bound infill ballast applied to the synthetic grass (stabilized against high velocity water shear forces).

Optionally, the infill ballast comprises a sand or soil and is bound with a binding agent, such as cement, grout, lime or the like.

With this invention, down-chutes and ditches can be lined with this system to resist large shear forces of water and wind without washing the soil below the system. The artificial turf provides for separation of the sand infill from the ground below and the turf blades act as structural reinforcement of the sand infill while providing an aesthetically pleasing surface. The sand infill on top is stabilized against washing or blowing away by a binding agent applied to the sand infill, which generally has the effect of cementing or bonding together the sand. This allows the invention to resist large shear forces from water or wind. In this regard, the bonding strength need not be terribly high. Indeed, it is not necessary to achieve a structural strength as great as concrete, for example. Instead, it is sufficient that the binding agent merely hold the sand together against erosive forces of wind and water. In this regard, the sand/soil is bound to the other sand particles and/or to the synthetic turf blades by the binder.

Figure 1:
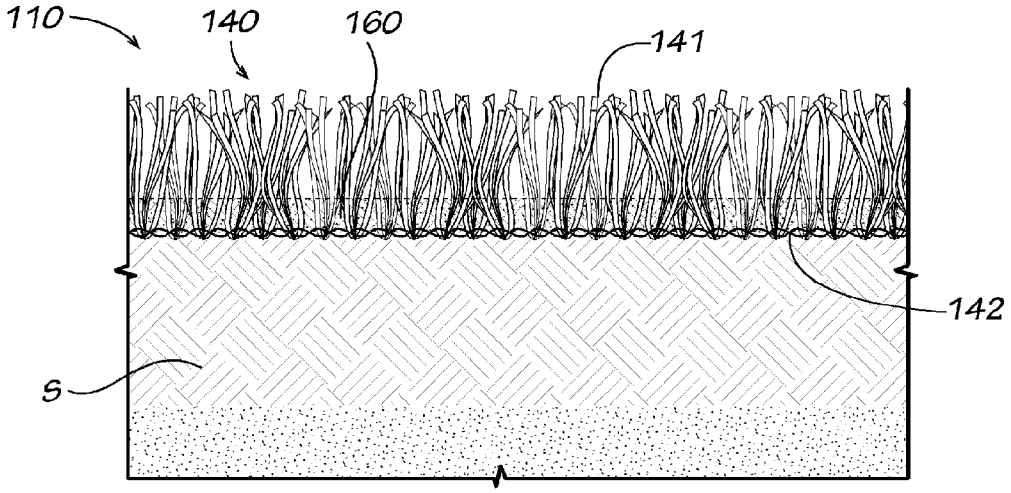
FIG. 1 is a schematic, sectional view of a synthetic ground cover system for erosion control according to a first example of the present invention.

FIG. 1 is a schematic, sectional view of an example synthetic ground cover system 110 for erosion control according the present invention and showing the surface of the soil S covered with the present ground cover erosion control system. The system includes a synthetic turf 140 which includes a backing 142 and synthetic turf blades 141 secured to the backing. A stabilized/bound sand/soil infill 160 is placed in the bottom of the synthetic turf 140 above the backing 142. The soil S can be topped with a sand subgrade, gravel subgrade, or intermediate cover before laying down the synthetic ground cover system 110 for erosion control, as desired. In this first example embodiment, the synthetic turf 140 is placed more or less directly atop the soil S. As will be seen below, the system can also be provided with additional elements interposed between the soil S and the turf 140.

Preferably, the synthetic turf 140 is used as a principal component of the synthetic ground cover system. It can be constructed using a knitting machine or tufting machine that may use, for example, over 1,000 needles to produce a turf width of about 15 feet. Preferably, the synthetic turf includes synthetic grass blades 141 which comprise polyethylene monofilament and/or slit-film fibrillated and non-fibrillated fibers tufted to have a blade length of between about 0.5 inches and 4 inches. Other polymers can be used for the synthetic grass blades, as desired. Preferably, the synthetic grass blades 141 are tufted to have a blade length of between about 1.5 inches and 3 inches. Most preferably, the synthetic grass blades 141 are tufted to have a blade length of about 1.5 inches. Optionally, the synthetic grass blades 141 are tufted to have a density of between about 20 ounces/square yard and about 120-ounces/square yard. Preferably, the synthetic grass blades have a thickness of at least about 100 microns.

The synthetic grass blades 141 are tufted into the substrate or backing 142 comprising a synthetic woven or non-woven fabric. Moreover, this backing can be a single ply backing or can be a multi-ply backing, as desired. Optionally, a geo filter can be secured to the substrate to reinforce the substrate and better secure the synthetic grass blades.

The chemical composition of the synthetic turf components should be selected to resist degradation by exposure to sunlight, which generates heat and contains ultraviolet radiation. The polymer yarns should not become brittle when subjected to low temperatures. The selection of the synthetic grass color and texture should be aesthetically pleasing.

The actual grass-like components preferably consist of green polyethylene fibers 141 of about 1.5 to about 2.5 inches in length tufted into a woven or non-woven geotextile(s). For added strength in severely steep side-slopes, an additional geo filter component backing can be tufted for improving dimensional stability. The polyethylene grass filaments 141 preferably have an extended operational life of at least 15 years.

A sand/soil layer 160 of about 0.5 to about 2.0 inches is placed atop the synthetic turf as infill to ballast the material and protect the system against wind uplift as well as to provide dimensional stability. Preferably, the infill is between about 0.5 and 1 inches. The sand/soil layer provides additional protection of the geotextiles against ultraviolet light. Moreover, the sand/soil ballast is bonded with cement, grout, lime or another binding agent in order to resist the shear forces of water and wind on steep side-slopes, drainage ditches and down-chutes. In this regard, the synthetic turf 140 is first placed over the ground and then the sand/soil infill is spread over the synthetic turf in dry form. This allows the dry infill material to easily and effectively settle into the bottom of the synthetic turf. Thereafter, the infill is watered (as by spraying water over the turf) and allowed to cure into a hardened, bound infill layer. In this regard, the sand/soil infill is bound to itself and is bound to the individual blades of the synthetic turf. Thus, in the event that the bound infill should become cracked in places, the individual blades of the turf act as anchors and help hold the bound infill in place.

The "sand/soil" infill includes true sands (including silica sands, quartz sands, etc), soils, clays, mixtures thereof, etc. It also includes things that are like sand or soil. For example, granular tailings from rock quarries could be employed (things like granular marble, quartz, granite, etc). Also, small gravel can be used as the "sand/soil" infill. In this regard, it is preferred that the infill be inorganic in nature so as to be very stable and long-lasting. But organic granular material could be employed in certain applications. Moreover, the binding agent could be inorganic or organic. Preferably, the binding agent is inorganic (again, for stability and long life). The cements, grouts, liming agents, etc., fit this application well. But other binding agents, such as organic binders, could be employed. For example, polymer-based binders could be used (for example, a urethane product). Indeed, in recent times a spray-on binding agent has come to market for binding small gravel in pathways under the brand name "Klingstone" and sold by Klingstone, Inc. of Waynesville, N.C.

Applicants have found that a recipe of about three parts sand and one part cement works well as a dry infill. Once wetted and cured, this bound sand infill provides an excellent ballast against lifting of the turf by wind and also resists damage or erosion from wind or rain or high water flows. A recipe of about equal parts sand and cement also works well, as do ratios between these two examples. However, for economic reasons, one should choose to use only as much cement as is needed to hold the infill together and to the synthetic turf blades, as cement is more costly than sand (generally). Thus, recipes closer to 3:1 are generally more economical but have lower strength, while recipes closer to 1:1 are generally stronger, but more expensive. Moreover, a recipe of 2:2:1 of sand/cement/lime works well also. Also, instead of lime one can use fly ash.

Advantageously, the present invention can be used even where high concentrated flows are expected (e.g. down-chutes, large drainage swales). To this end the sand/soil infill is stabilized with a binding agent, such as cement, grout, lime, etc. This creates a more or less grouted or bound sand/soil infill 160 to resist the shear forces of water flow and wind.

This invention combines the use of a synthetic grass to provide a pleasant visual appearance, erosion protection with very minimal maintenance. The invention incorporates a bound infill that, together with the synthetic grass, can handle very rapid water run-offs. Thus, the cover system of this invention can be installed on very steep slopes which typically occur in embankments, levees, dams, downchutes, landfills and stockpiles. The system can be used as erosion control material that can resist large shear forces of water or wind.

In addition to the embodiments described above, the system can take other forms. For example, the system can comprise a membrane with a drainage layer overlain by synthetic turf having cemented (stabilized) infill using any of the binding agents described herein and the like. In such an embodiment, a bottom layer includes a structured low permeable membrane (optionally with textured or spikes on bottom side and drainage studs on top side) and a top layer. The top layer can include turf (with, for example, 1.5 inch pile height) and an infill of sand, lime and cement mixture. In one example, the infill can be 0.75 inches of the mixture.

Figure 2:
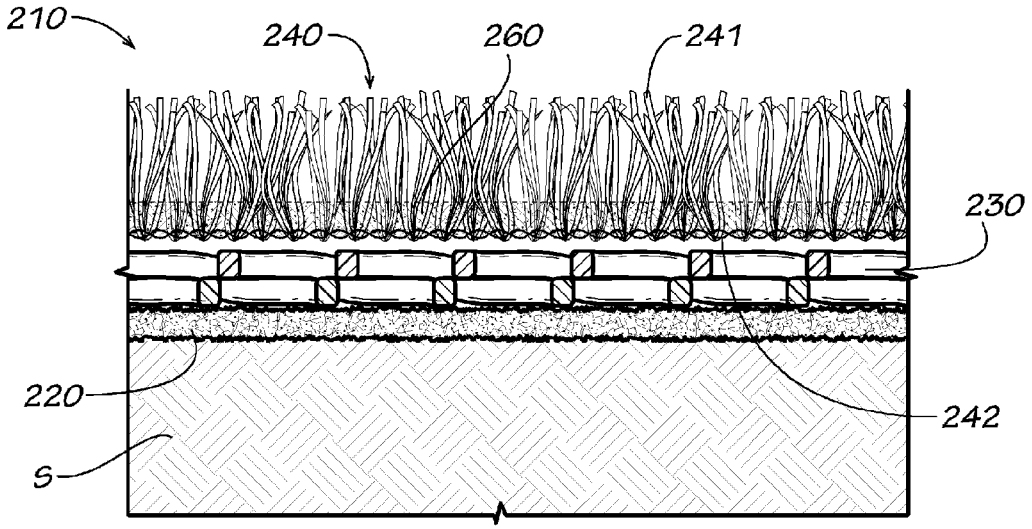
FIG. 2 is a schematic, sectional view of a synthetic ground cover system for erosion control according to another example of the present invention, shown with an open mesh grid drainage at the bottom of the system.

FIG. 2 is a schematic, sectional view of a synthetic ground cover system 210 for erosion control according to a second example of the present invention, shown without an open mesh grid at the bottom of the system. Similarly to the example embodiment of FIG. 1, the example cover system 210 for erosion control shown in FIG. 2 is used to control erosion of the soil S. The system 210 includes a lower filter fabric (geofilter) 220, an open grid mesh or geo-net 230 and a synthetic turf 240. The synthetic turf 240 includes a backing 242 and blades 241 secured to the backing. A stabilized/bound sand/soil infill 260 is placed in the bottom of the synthetic turf 240 above the backing 242. The soil S can be topped with a sand subgrade, gravel subgrade, or intermediate cover before laying down the synthetic ground cover system 210 for erosion control, as desired. Preferably, the lower filter fabric 220 comprises a woven or non-woven synthetic fabric. In some applications, the lower filter fabric 220 can be replaced with a barrier geomembrane with low permeability.

Figure 3A:
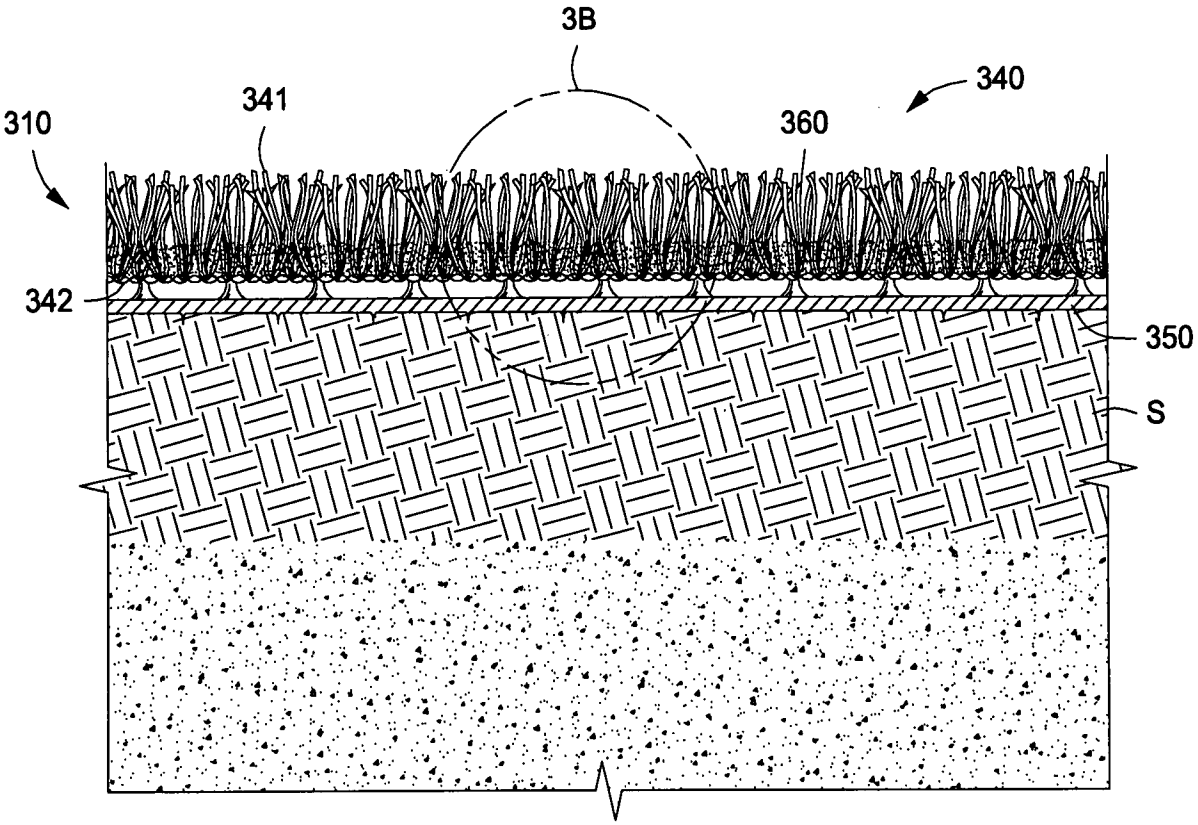
FIG. 3A is a schematic, sectional view of a synthetic ground cover system for erosion control according to another example of the present invention.
Figure 3B:
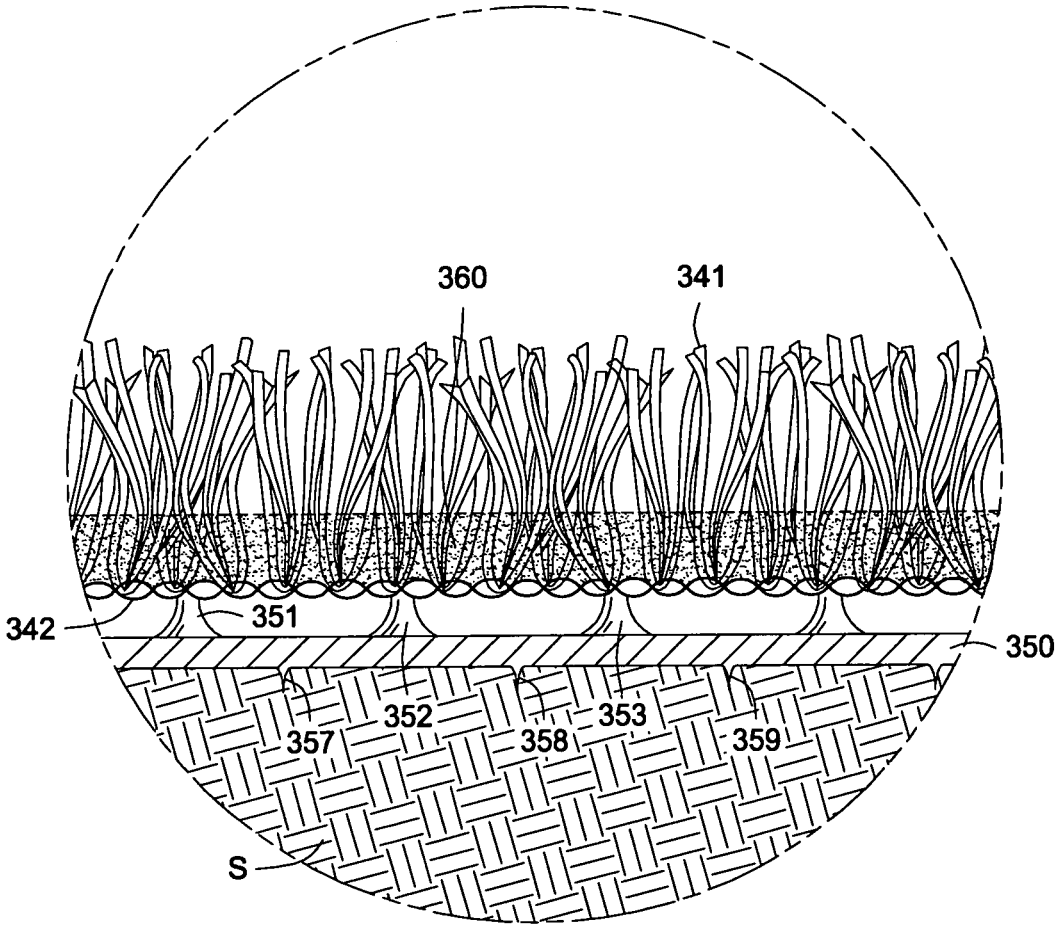
FIG. 3B is a schematic, detailed sectional view of the synthetic ground cover system for erosion control of FIG. 3A.

FIGS. 3A and 3B depict a synthetic ground cover system 310 for erosion control according to a third example of the present invention, shown without an open mesh grid at the bottom of the system. Similarly to the example embodiment of FIG. 1, the example cover system 310 for erosion control shown in these figures is used to control erosion of the soil S. The system 310 includes an impermeable geomembrane 350 and a synthetic turf 340. The impermeable geomembrane 350 is a polymeric sheet with slender spikes on the bottom surface and cleat-like or stud-like nubs on the top surface. For example, see upper nubs 351-354 and spikes 357-359. The lower spikes help anchor the impermeable geomembrane to the soil S and the upper nubs help anchor the synthetic turf 340 to the impermeable geomembrane 350. The upper nubs also provide a transmissive drainage layer or space in which water can flow over the membrane beneath the synthetic turf. The synthetic turf 340 includes a backing 342 and blades 341 secured to the backing. A stabilized/bound sand/soil infill 360 is placed in the bottom of the synthetic turf 340 above the backing 342.

Figure 4:
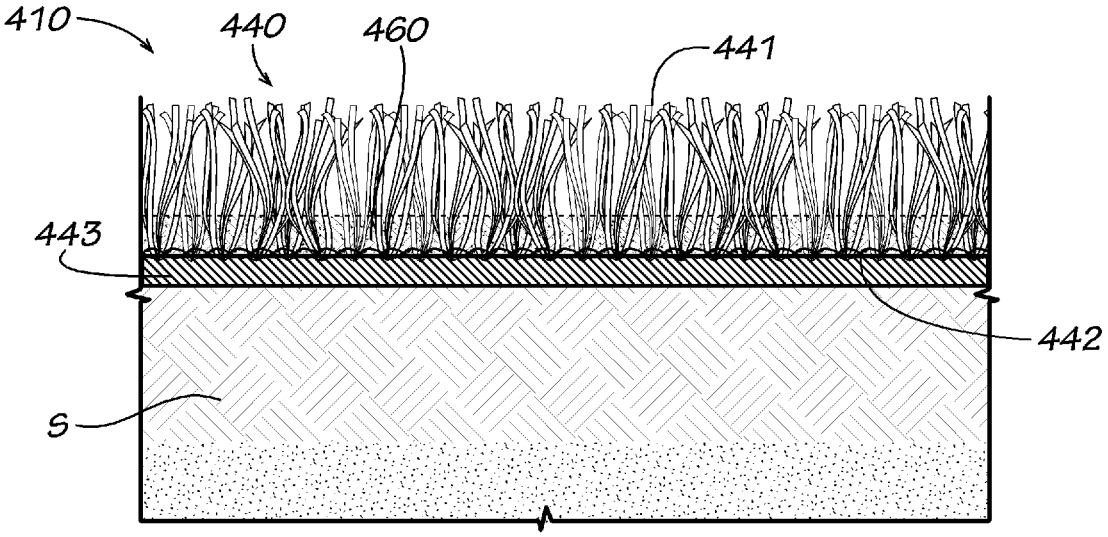
FIG. 4 is a schematic, sectional view of a synthetic ground cover system for erosion control according to another example of the present invention.

FIG. 4 is a schematic, sectional view of another synthetic ground cover system 410 for erosion control according to the present invention, shown with a reinforcement layer on the backing of the synthetic turf. Similarly to the example embodiment of FIG. 1, the example cover system 410 for erosion control shown in FIG. 4 is used to control erosion of the soil S. The system 410 includes a synthetic turf 440 which includes a backing 442 and blades 441 secured to the backing. The backing 442 can be a single ply backing or a multi-ply backing. A urethane barrier 443 is applied to the underside of the backing 442 and acts to both strengthen the backing and the connection between the blades 441 and the backing 442. The urethane barrier 443 also makes the backing 442 generally impermeable to water. A stabilized/bound sand/soil infill 460 is placed in the bottom of the synthetic turf 440 above the backing 442.

Figures 5A, 5B:
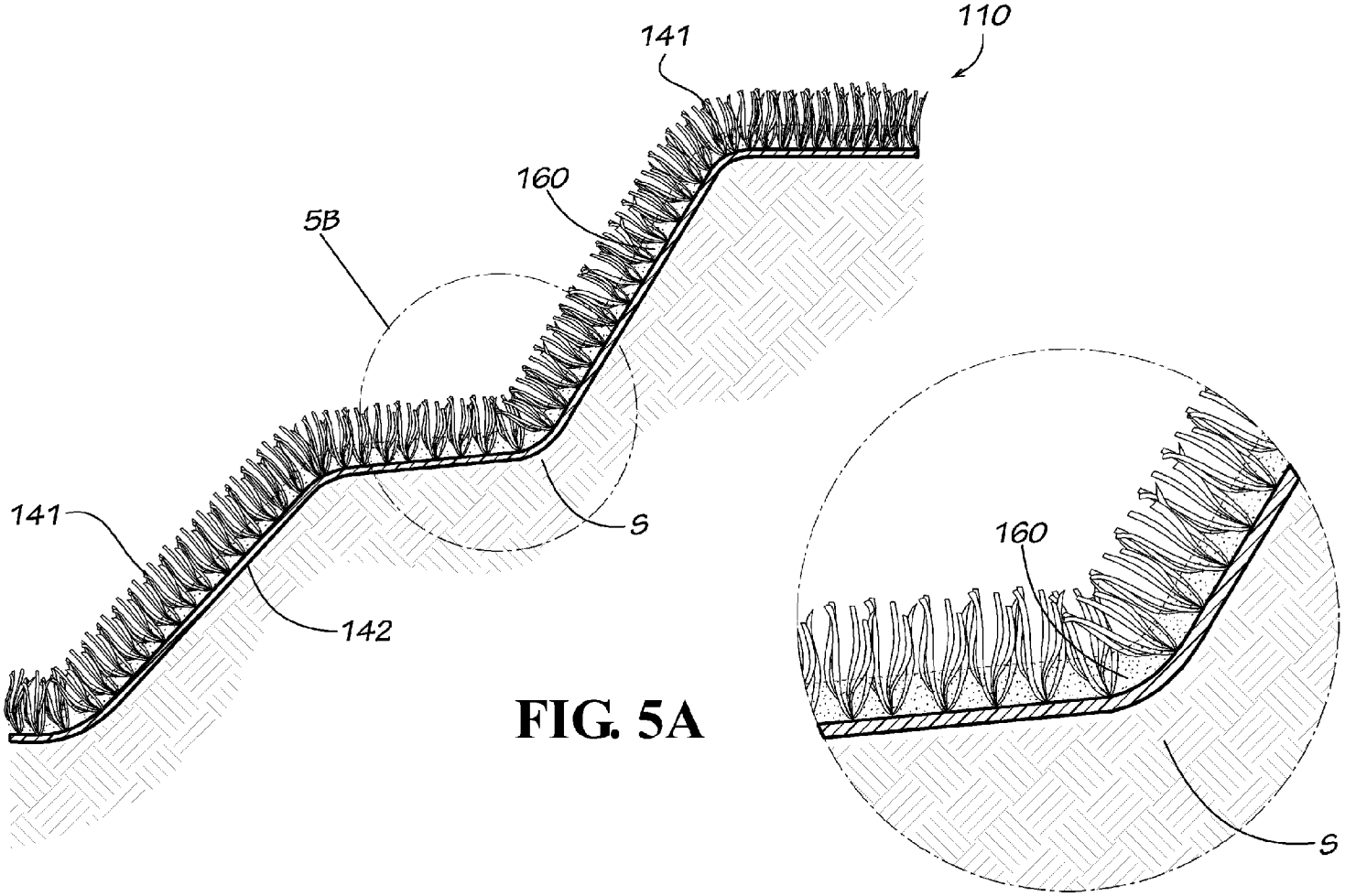
FIG. 5A is a schematic, sectional view of the synthetic ground cover system for erosion control of FIG. 1 and shown installed over terrain of various slopes.
FIG. 5B is a schematic, detailed sectional view of the synthetic ground cover system for erosion control of FIG. 5A.

FIGS. 5A and 5B show the example embodiment of FIG. 1 applied over a terrain of varying slopes. This synthetic ground cover system 110 has the capacity to handle high-intensity precipitation and avoids erosion of the sand/soil infill ballast and/or the shearing stresses on the turf ranging from 1 pound per square foot to more than 25 pounds per square foot.

The applicants have found that sand works particularly well as the primary ballast agent, although soil works well as well. Even small gravel could be employed as the primary ballast agent. Moreover, the applicants have found that the binding agent that works the best in most applications is cement, although other binding agents could work very also. Thus, while cementitious materials are the preferred binders, other materials could work also.

Figure 6A:
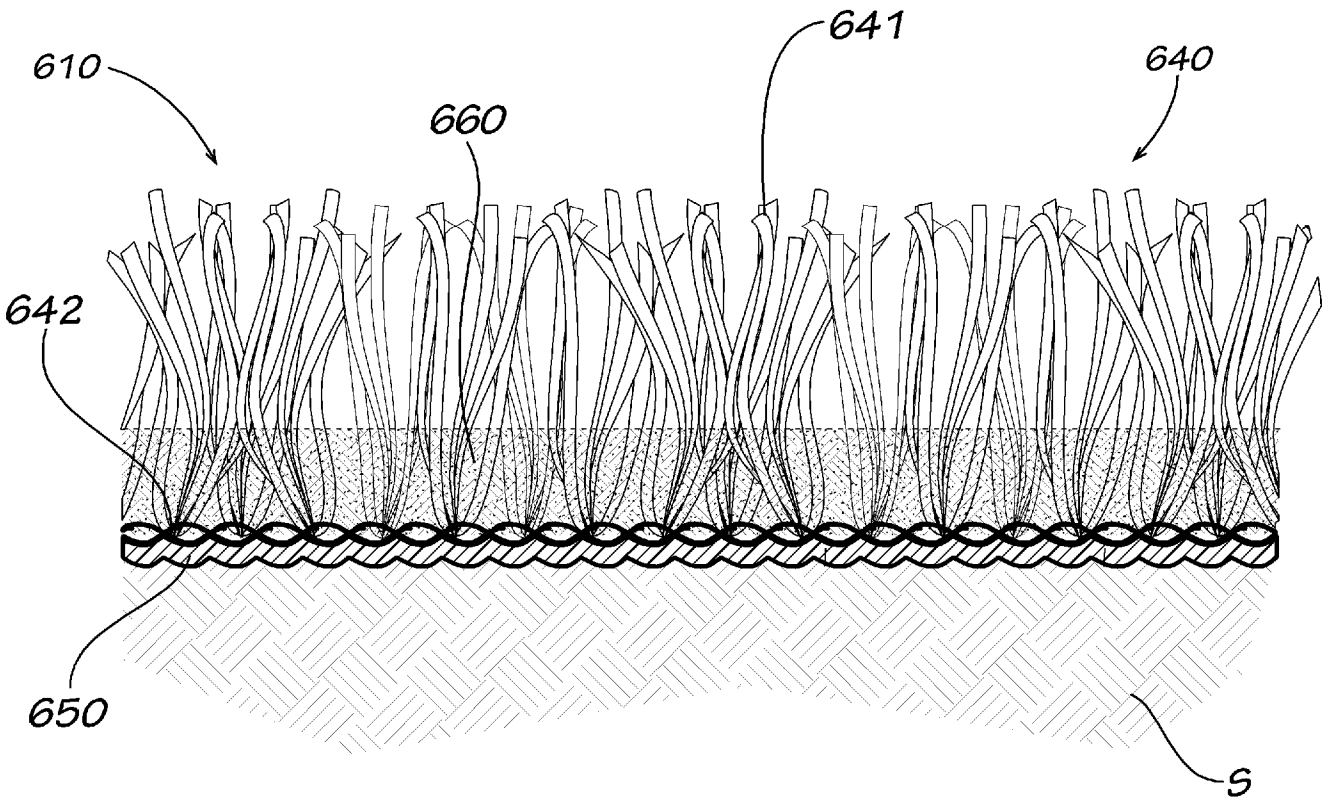
FIG. 6A is a schematic, sectional view of a synthetic ground cover system for erosion control according to another example of the present invention.
Figure 6C:
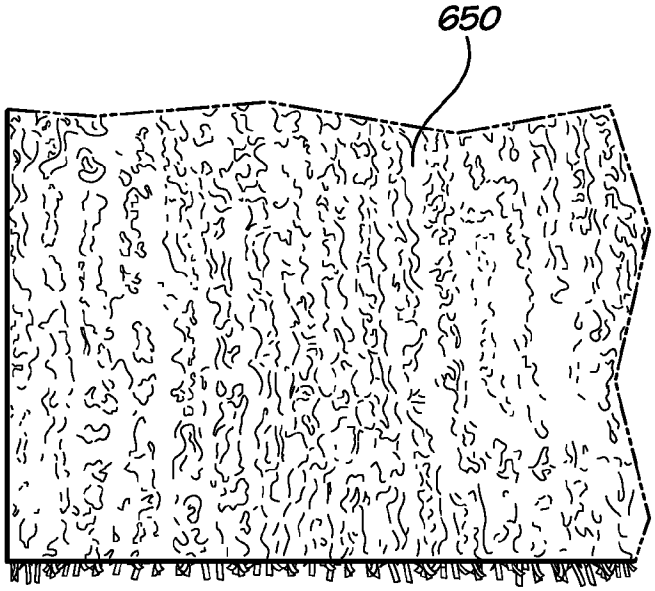
FIG. 6C is a bottom perspective view of the synthetic ground cover of FIG. 6A.

FIG. 6A is a schematic, sectional view of a synthetic ground cover system 610 for erosion control according to another example of the present invention. Similarly to the example embodiment of FIG. 1, the ground cover system 610 for erosion control is used to control the erosion of the soil S. The system 610 generally includes a synthetic turf 640 which includes a backing 642 and blades 641 secured to the backing. The backing 642 can be a single ply or a multi-ply backing. An impermeable backing or layer 650 is applied to or formed on the underside of the backing 642 and acts to strengthen both the backing 642 and the connection between the blades 641 and the backing 642. Preferably, the impermeable layer 650 makes the backing 642 generally impermeable to water, thus water or other liquids present above the backing 642 are prevented from penetrating the soil S. An infill ballast 660 is applied to the synthetic grass atop the backing and a binding agent is applied to the infill ballast to protect the infill ballast against high velocity water shear forces.

Figure 6B:
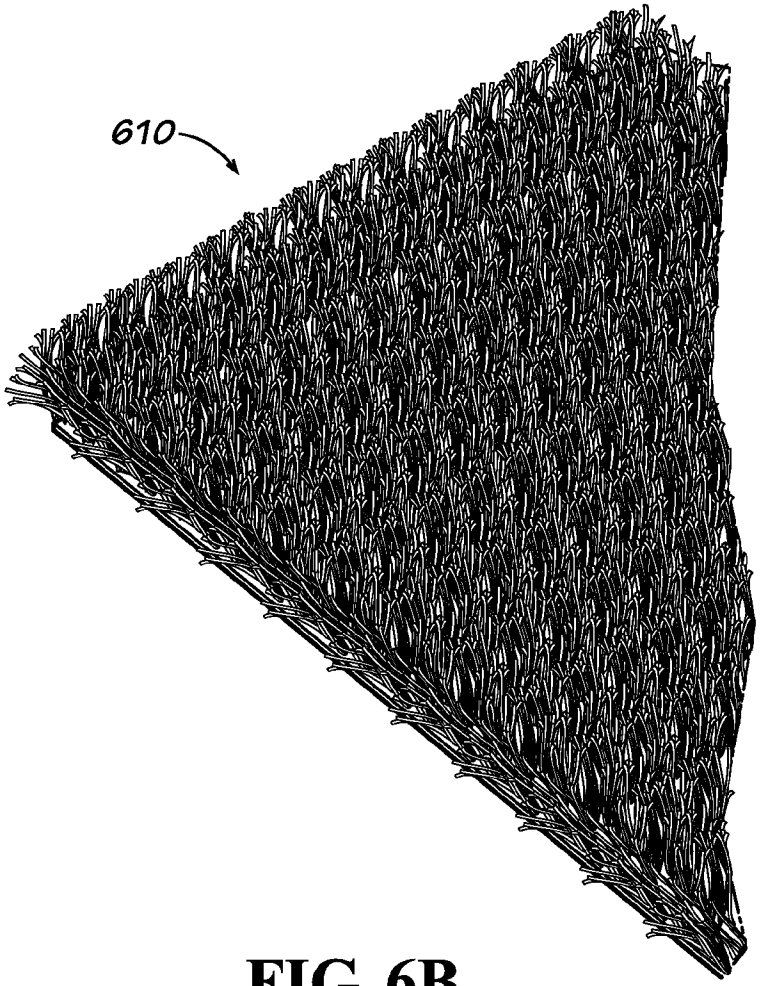
FIG. 6B is a top perspective view of the synthetic ground cover of FIG. 6A.

Preferably, the impermeable layer or backing 650 comprises a geotextile. Optionally, the impermeable layer 650 comprises a permeable geotextile and an impermeable polymer applied to the permeable geotextile to make the layer 650 impermeable. Optionally, the impermeable polymer comprises Polyethylene, Polypropylene, Polyurethane, EPDM, or PVC. In one form, the impermeable polymer is sprayed onto the permeable geotextile and then cured. Optionally, the impermeable polymer is laminated, glued, coated, or otherwise applied to the permeable geotextile. In example forms, the impermeable backing 650 is substantially non-flat for gripping the non-level, sloping ground (see FIG. 6B).

In one optional form, solid elements may be incorporated with the impermeable polymer to provide for greater gripping ability when placing the ground cover system 610 on non-level, sloping ground. For example, in one form, a plurality of solid or pointy jack-like objects are placed on the permeable geotextile and the impermeable polymer is applied to the permeable geotextile, thus affixing the plurality of objects thereto to provide a non-flat impermeable layer 650. In another optional form, the plurality of objects are incorporated within the impermeable polymer and are affixed to the permeable geotextile upon spraying or applying the impermeable polymer on the permeable geotextile. In yet another optional form, a generally thin grid-like component comprising a plurality of spikes or extruding members is placed atop the permeable geotextile and the impermeable polymer is applied atop the grid-like component, thereby affixing the grid-like component in the impermeable layer 650.

Preferably, by providing the non-flat impermeable layer 650 that is affixed to the ground cover system 610, the ground cover system 610 can be installed on non-level, sloping ground in a one-step process, which can be seen to reduce manufacturing and installation costs.

There are many advantages to the cover system of this invention. The cover system reduces construction costs, reduces annual operation and maintenance costs while providing superior and reliable/consistent aesthetics. It also reduces the need for expensive riprap channels and drainage benches, with substantially no erosion or siltation problems, even during severe weather. It is a good choice in sensitive areas where soil erosion and sedimentation are major concerns because soil loss is substantially reduced. It also eliminates the need for siltation ponds and associated environmental construction impacts. It allows for steeper slopes, because there will be a reduced risk of soil stability problems.

While the invention has been shown and described in exemplary forms, it will be apparent to those skilled in the art that many modifications, additions, and deletions can be made therein without departing from the spirit and scope of the invention as defined by the following claims.

What is claimed is:

1. A synthetic ground cover system for erosion control to be placed atop substantially non-level, sloping ground, comprising:

a synthetic grass which comprises a composite of an impermeable backing and synthetic grass blade-like elements secured thereto and extending therefrom;

an infill ballast applied to the synthetic grass atop the backing;

a binding agent applied to the infill ballast to protect the infill ballast against high velocity water shear forces; and wherein the synthetic ground cover system can remain in place atop substantially non-level, sloping ground despite shear forces from gravity, wind, and water flow, and wherein water does not drain through the impermeable backing.

2. The synthetic ground cover system for erosion control as defined in claim 1 wherein the impermeable backing comprises a geotextile.

3. The synthetic ground cover system for erosion control as defined in claim 1 wherein the impermeable backing comprises a permeable geotextile and an impermeable polymer applied to the permeable geotextile to make the backing impermeable.

4. The synthetic ground cover system for erosion control as defined in claim 3 wherein the impermeable polymer comprises polyethylene, polypropylene, polyurethane, ethylene propylene diene terpolymer or polyvinyl chloride.

5. The synthetic ground cover system for erosion control as defined in claim 3 wherein the impermeable polymer has an average thickness of about 5 to 40 mils.

6. The synthetic ground cover system for erosion control as defined in claim 3 wherein the impermeable polymer is laminated, glued, sprayed or coated on the permeable geotextile.

7. The synthetic ground cover system for erosion control as defined in claim 3 wherein the impermeable polymer is non-flat for gripping the non-level, sloping ground.

8. The synthetic ground cover system for erosion control as defined in claim 1 wherein the binding agent comprises a cementitious material which is subsequently cured with water.

9. The synthetic ground cover system for erosion control as defined in claim 1 wherein the binding agent is applied as an emulsion in water.

10. The synthetic ground cover system for erosion control as defined in claim 1 wherein the binding agent comprises lime.

11. The synthetic ground cover system for erosion control as defined in claim 1 wherein the binding agent comprises grout.

12. The synthetic ground cover system for erosion control as defined in claim 1 wherein the binding agent comprises cement.

13. The synthetic ground cover system for erosion control as defined in claim 1 wherein the binding agent comprises a polymer.

14. The synthetic ground cover system for erosion control as defined in claim 1 wherein the infill is applied to the synthetic grass in a dry condition and then is wetted later to be cured into a bound infill.

15. The synthetic ground cover system for erosion control as defined in claim 1 wherein the binding agent applied to the infill results in a bound infill having a depth of between about ½ inch and about 2 inches.

16. The synthetic ground cover system for erosion control as defined in claim 1 wherein the synthetic grass blades act as anchors to help secure the infill and wherein the infill is bound to the synthetic grass blades.

17. The synthetic ground cover system for erosion control as defined in claim 1 wherein the synthetic grass has fibers with an average length of between about 0.5 and 3 inches that act as reinforcement for the infill.

18. The synthetic ground cover system for erosion control as defined in claim 1 wherein the synthetic grass comprises polyethylene, polypropylene, or nylon fibers.

19. The synthetic ground cover system for erosion control as defined in claim 1 wherein the synthetic grass comprises monofilament or slit film fibers.

20. The synthetic ground cover system for erosion control as defined in claim 1 wherein the synthetic grass has a density of between about 15 ounces per square yard and 120 ounces per square yard.

21. The synthetic ground cover system for erosion control as defined in claim 1 wherein the infill comprises sand and the binding agent comprises cement.

22. The synthetic ground cover system for erosion control as defined in claim 21 wherein the ratio of sand to cement is between about 1:1 and 5:1 by weight.

23. The synthetic ground cover system for erosion control as defined in claim 1 wherein the infill ballast is inorganic and the binding agent is inorganic.

24. The synthetic ground cover system for erosion control as defined in claim 1 wherein at least one of the infill ballast or the binding agent is organic.

* * * * *